US006065307A

United States Patent [19]

Freilich

[11] Patent Number: 6,065,307

[45] Date of Patent: May 23, 2000

[54] CORNER CUT PRECIOUS SQUARE STONES

[75] Inventor: Joseph Freilich, Old Westbury, N.Y.

[73] Assignee: M. Fabrikant & Sons, Ltd., New York, N.Y.

[21] Appl. No.: 09/332,667

[22] Filed: Jun. 14, 1999

[51] Int. Cl.[7] ..... A44C 17/02

[52] U.S. Cl. ..... 63/26; 63/28; 63/32; D11/89; D11/90; D11/91

[58] Field of Search ..... 63/26, 27, 28, 63/32; D11/89, 90, 91, 92

[56] References Cited

U.S. PATENT DOCUMENTS

| | | | |
|---|---|---|---|
| D. 15,419 | 9/1884 | Smith | D6/581 |
| D. 68,596 | 10/1925 | Robbins | D11/90 |
| D. 71,935 | 1/1927 | Stern | D11/90 |
| D. 73,109 | 7/1927 | Stern | D11/90 |
| D. 114,649 | 5/1939 | Simon | D11/89 |
| D. 363,253 | 10/1995 | Sikorski et al. | D11/90 |
| D. 373,971 | 9/1996 | Katz | D11/90 |
| D. 387,302 | 12/1997 | Itzkowitz | D11/90 |
| D. 388,015 | 12/1997 | Itzkowitz | D11/90 |
| D. 389,087 | 1/1998 | Kattan | D11/90 |
| D. 393,230 | 4/1998 | Katz | D11/90 |
| D. 405,024 | 2/1999 | Katz | D11/90 |
| D. 413,544 | 9/1999 | Steinberg | D11/91 |
| D. 415,062 | 10/1999 | Wolf | D11/90 |
| 2,207,869 | 7/1940 | Monnier | 63/32 |
| 2,907,187 | 10/1959 | Karp et al. | 63/28 |
| 3,394,692 | 7/1968 | Sirakian . | |
| 4,813,246 | 3/1989 | Richards . | |
| 4,914,930 | 4/1990 | Bielka . | |
| 5,533,364 | 7/1996 | Freilich . | |
| 5,622,063 | 4/1997 | Slowinski . | |

FOREIGN PATENT DOCUMENTS

| | | | |
|---|---|---|---|
| 611808 | 10/1926 | France | 63/32 |
| 341674 | 11/1959 | Switzerland | 63/27 |

*Primary Examiner*—Terry Lee Melius
*Assistant Examiner*—Andrea Chop
*Attorney, Agent, or Firm*—Levisohn, Lerner, Berger & Langsam

[57] ABSTRACT

A combination precious or semi-precious stone setting is formed utilizing princess or square cut stones having their edges lopped off, with at least two of the stones joined edge to edge forming a space where the lopped off corners were located, further including a square cut stone placed in this space to form a novel and enhanced appearing jewelry setting.

9 Claims, 7 Drawing Sheets

CORNER CUT PRECIOUS SQUARE STONES

BACKGROUND OF THE INVENTION

This invention relates to a novel cut precious stone allowing for providing a combination of such cut stones to give the appearance of a larger single brilliant stone, thereby enhancing the appearance and apparent value of the resulting combination.

Precious gems and stones exist in many sizes and shapes, and many cuts have been provided through the ages. One of the purposes for providing unique cuts for precious stones is to enhance the appearance of the stone and resulting jewelry setting.

There exists in the jewelry industry a cut known as a radiant cut. The radiant cut is a rectangular stone with its corners cut providing a more oval appearance. Such stones are generally set by themselves providing the larger rounded appearance and an overall enhanced effect.

To the inventor's knowledge, no one has utilized square precious stones such as diamonds (generally known as princess cut) with the corners "lopped off". The inventor has discovered by uniformly lopping off the four corners of a square stone and thereby placing a group of such stones contiguous to each other, an open or a center area is formed which can accommodate an additional square or princess cut stone. The inventor has discovered that this applies to any princess or square cut stone having all four corners uniformly lopped off, and with four such stones of equal size joined together, an open center area is formed. When such corners are lopped off at an angle, the bevel created along that angled edge in conjunction with the angled bevel in the facing stone creates such brilliance so as to substantially hide the gap between the stones and create the illusion of a single stone.

Additionally, another embodiment of this invention relates to providing a plurality of increasing sizes of such square cut stones in which tiers of such stones are mounted edge to edge, with their cut corners providing space for an additional square stone to be inserted therein thereby providing an overall enhanced appearance.

The common factor in the invention is that the square or princess cut stones have all four corners cut substantially equally thereby providing a squared-off border area when the stones are set edge to edge.

While this invention is described with relation to precious stones such as diamonds, it could also apply to CZ and other stones having a brilliant appearance which is enhanced by providing a larger stone weight joined together giving the overall appearance of a larger uniform single stone.

It is therefore an object of this invention to provide a new cut for precious and semi-precious stones providing an overall enhanced appearance for the resulting combination and enhancing its value.

It is another object of this invention to provide such a cut which will be easy to practice, susceptible to widespread use and widely popular.

Yet another object of this invention is to provide a new precious and semiprecious stone cut so as to draw an observer to more easily notice the resulting stone combinations.

Other objects, advantages and features of this invention will become more apparent from the following description.

DETAILED DESCRIPTION

Figure 1:
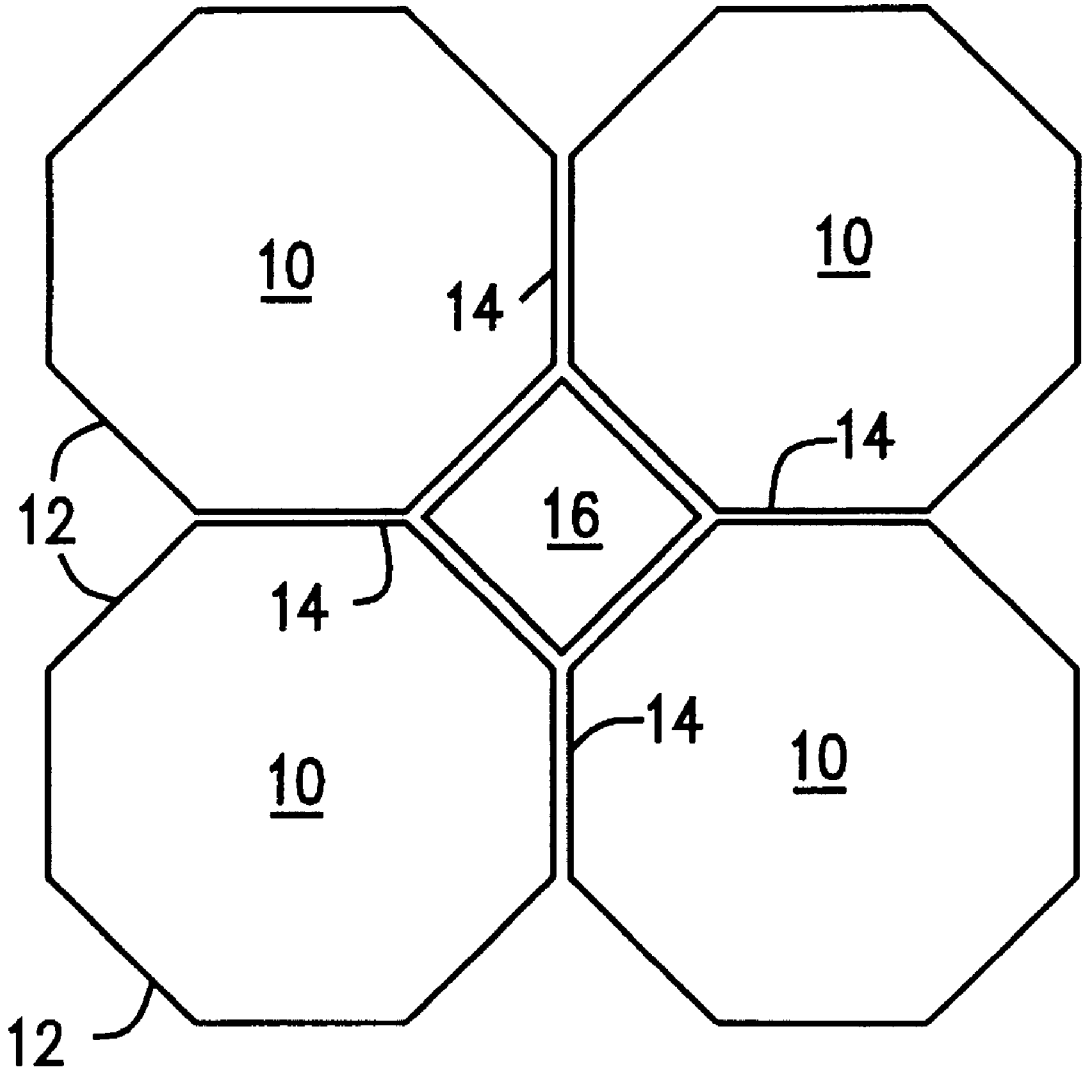
FIG. 1 is a top plan view of four square stones with their corners lopped off joined edge to edge to form a center region which itself accommodates a princess cut stone.

FIG. 1 is a top plan view of an arrangement of precious or semi-precious stones cut in a manner taught by this invention. In particular, four such stones 10 all originally square have their respective corners 12 cut substantially equally and at substantially equal angles to form corner cut stones. The term equal angles refers to the angle of the cut. The angle of the cut is considered in relation to the straight edge of the stone in which the cut is made. The stones 10 are joined substantially at their abutting edges 14, and the inventor herein has determined that a square opening is formed in the center area 16 between the four cut stones 10. The larger the corner cuts 12 of the stones, the larger will be the center opening 16 formed between the stones which will accommodate a larger central stone 17.

The overall effect of this cut and arrangement of stones is to form the appearance of a larger princess cut stone which, because of the brilliance of such stones, produces the apparent size appearance of a large center stone with its diagonal size extending from one opposite cut corner of one stone to the opposite cut corner of the diametrically opposed stone. When such corners are lopped off at an angle, the bevel created along that angled edge in conjunction with the angled bevel in the facing stone creates such brilliance so as to substantially hide the gap between the stones and create the illusion of a single stone. Such an enhanced visual appearance is remarkable considering the original sizes of the princess stones 10.

The stones can be set in the conventional way with prongs holding the stones in place or by using an invisible setting so that the stones abut edge to edge without intervening metal therebetween. Such stone setting techniques are well known in the prior art.

Figure 2:
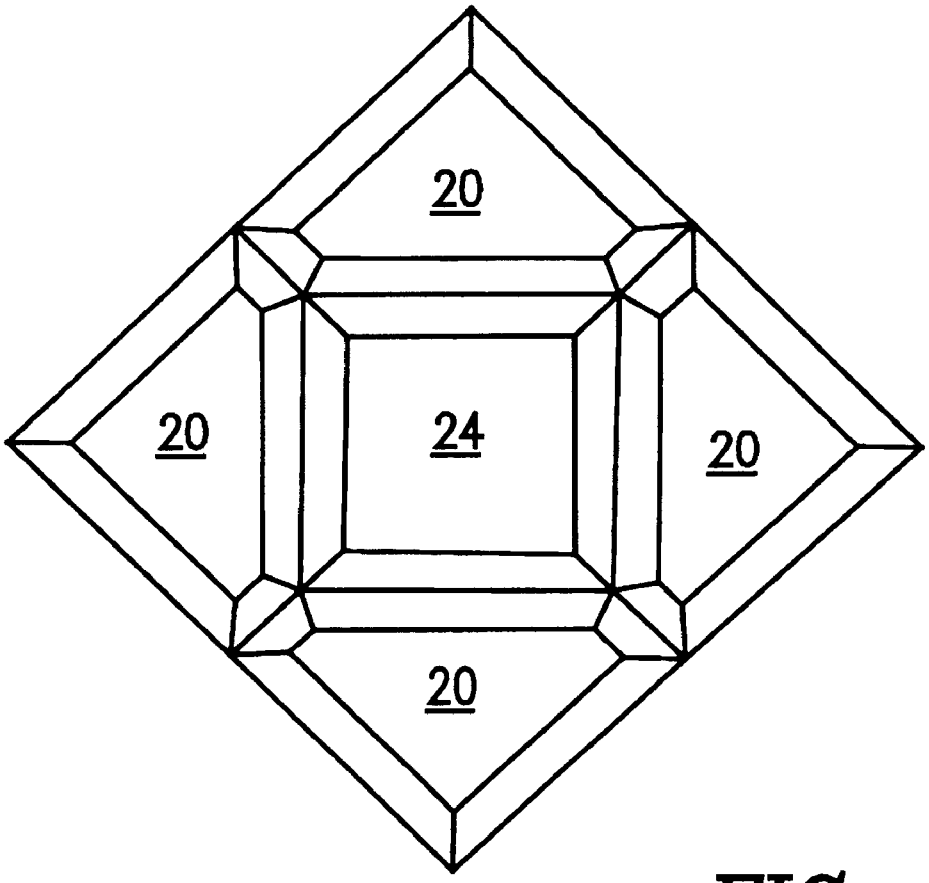
FIG. 2 is a top plan view of another embodiment of this invention in which a larger portion of the corners of the square stone are cut off and are thereby arranged to form a composite stone structure formed of five separate stone elements.
Figure 3:
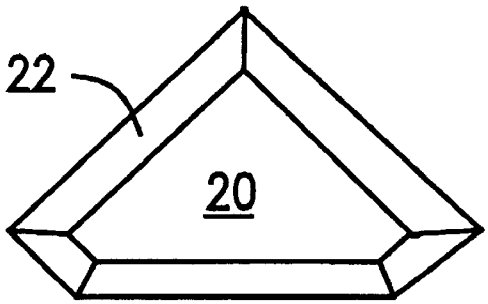
FIG. 3 is a top view of one of the original square cut stones having a corner thereof lopped off as used in the embodiment of FIG. 2.
Figure 4:
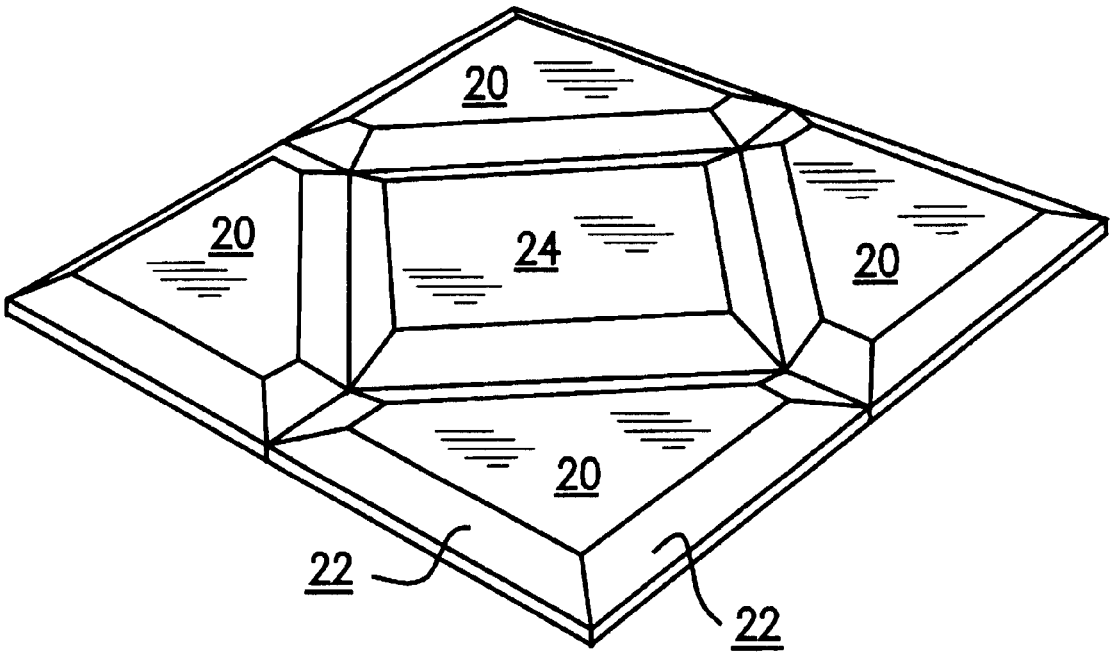
FIG. 4 is a perspective view of composite stones formed in FIG. 2.

FIGS. 2, 3 and 4 relate to an alternative embodiment of the present invention in which a square stone 20 has its corner cut off and is shown in FIG. 3, with an edge bevel 22 around the stone. The stones are set as in FIG. 2 with a central princess cut stone 24 filling the space formed in the center of the four cut princess stones 20. Again the stones may be set either with conventional prongs or by an invisible setting further enhancing the visual appearance of the composite stone.

Figure 5:
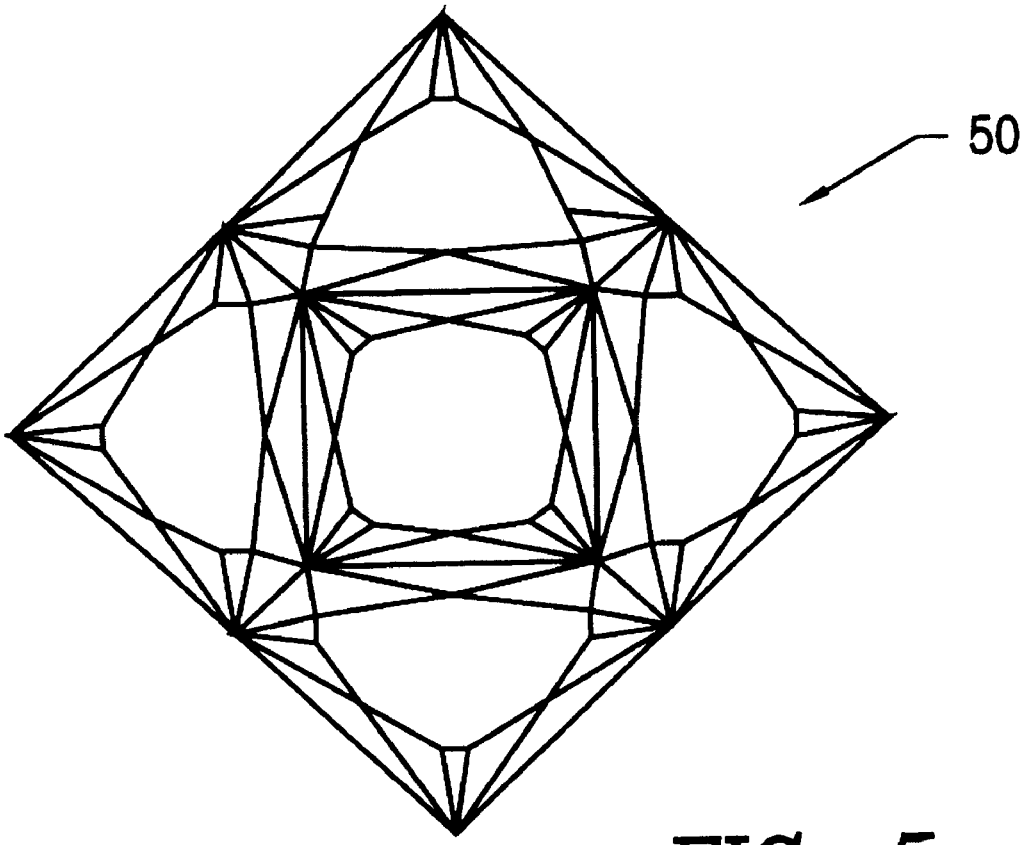
FIG. 5 is a top view of another embodiment of this invention in which the square cut stones are heavily faceted.
Figure 6:
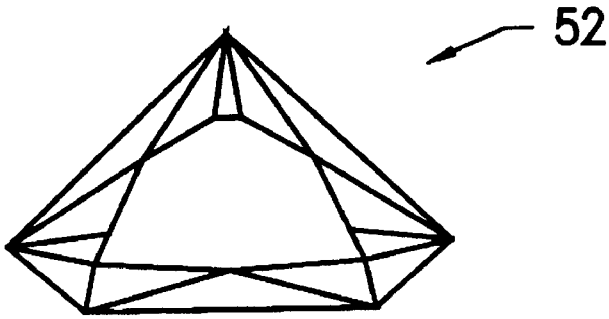
FIG. 6 is a top view of one of the princess cut stones illustrated in FIG. 5 having its corner cut off.
Figure 7:
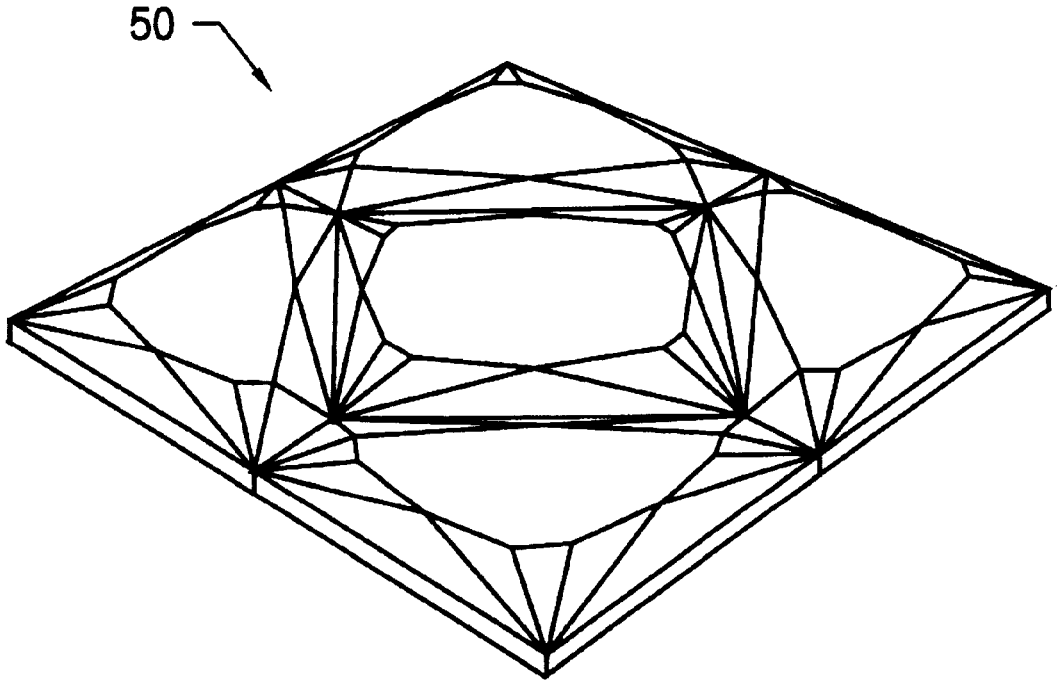
FIG. 7 is a perspective view of the embodiment of FIG. 5.

FIGS. 5–7 relate to another embodiment of this invention in which a highly faceted princess cut stone is utilized to practice the invention. The highly faceted stones enhances the overall brilliance of the composite structure 50. FIG. 6 illustrates one of such stones 52 with its corner cut.

The beveled angled edge is especially present in the embodiments of FIGS. 2–8 to mask the border between edges and create the illusion of a larger single stone.

Figure 8:
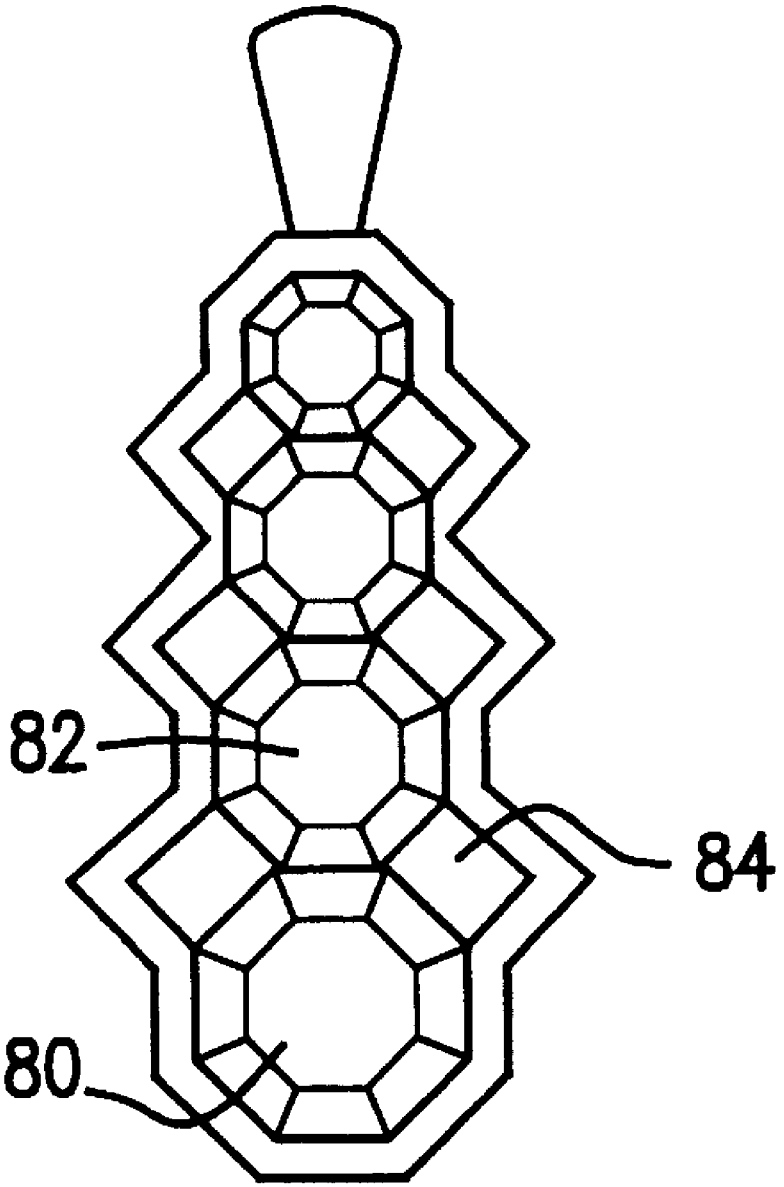
FIG. 8 is a top plan view of another embodiment of this invention in which the corners of different sized square stones are all cut at the same angle and a small square cut stone is placed between two adjoining stones which butt edge to edge.
Figure 9:
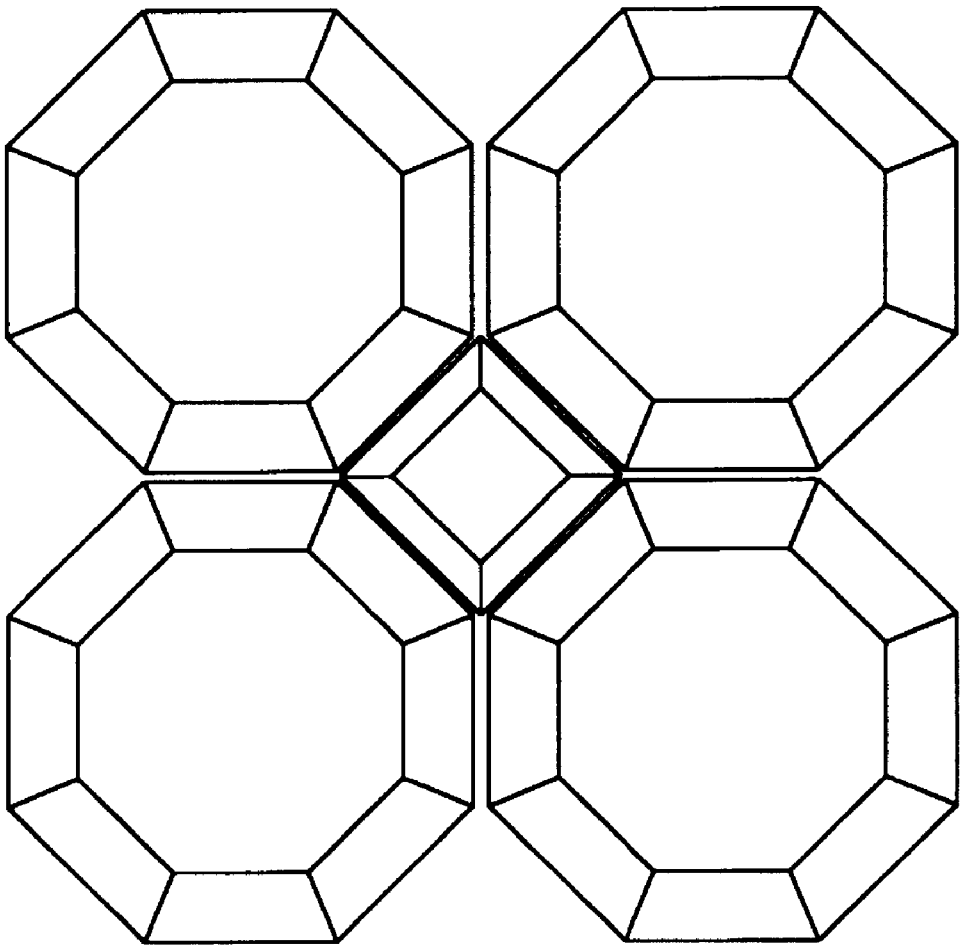
FIG. 9 is a top plan view of four faceted square stones with their corners lopped off joined edge to edge to form a center region which itself accommodates a faceted princess cut stone.

FIG. 8 is a plan view of yet another embodiment of this invention in which the square cut stones 80 have their corners cut at equal angles. A row of such stones is formed and the stones 80 and 82 vary in size as do the other stones, but all stones are cut at equal angles. A pair of side square stones 84 are placed in the areas between adjoining stones. Here again, an overall enhanced visual appearance is produced with this invention.

Many other variations and applications of the invention will be apparent. The above specification and the detailed description of the preferred embodiments are to be considered as representative only, as the scope of the invention is intended to be covered by the scope of the claims, as interpreted by the courts, and their reasonable and legal equivalents, as also interpreted by the Courts and the applicable statutes.

What is claimed is:

1. A composite jewelry stone combination comprising four square cut stones, said four square cut stones being of equal size, each of said four square cut stones having each of their corners substantially equally lopped off resulting in four equal in size corner cut stones, said four corner cut stones directly joined edge to edge to form a space wherein a corner of each of said corner cut stones existed, and a fifth square cut stone placed in said space, wherein said fifth square cut stone has an appearance of having the same shape as each of the unlopped four square cut stones and wherein said composite jewelry stone combination has an appearance of a single princess cut stone.

2. A composite jewelry stone combination according to claim 1, wherein each of said corners of each of said four square cut stones are cut at substantially equal angles.

3. A composite jewelry stone combination according to claim 1, wherein said square cut stones are faceted.

4. A composite jewelry stone combination according to claim 3, wherein said square cut stones comprise multiple facets.

5. A composite jewelry stone combination according to claim 1, wherein said square cut stones are faceted.

6. A composite jewelry stone combination according to claim 5, wherein said square cut stones comprise multiple facets.

7. A composite jewelry stone combination according to claim 1, wherein said square cut stones comprise multiple facets.

8. A composite jewelry stone combination comprising four corner stones, said corner stones being of equal size, each of said four corner stones comprising a generally triangular shape, each of said four corner stones having a matching edge, said four corner stones directly joined corner to corner to form a space between said matching edges of each of said four corner stones, and a fifth stone being of square cut and having matching edges with said matching edges of each of said four corner stones, said fifth stone being placed in said space wherein two other edges of each of said four corner stones have the same shape as two edges of said fifth stone, and wherein said composite jewelry stone combination has an appearance of a single princess cut stone.

9. A composite jewelry stone combination according to claim 8, wherein said matching edge of each of said corner stones comprises a substantially lopped off corner.

* * * * *

US006065307B1

(12) REEXAMINATION CERTIFICATE (4476th)

United States Patent

Freilich

(10) Number: US 6,065,307 C1

(45) Certificate Issued: Oct. 30, 2001

(54) CORNER CUT PRECIOUS SQUARE STONES

(75) Inventor: Joseph Freilich, Old Westbury, NY (US)

(73) Assignee: M. Fabrikant and Sons, New York, NY (US)

Reexamination Request:
No. 90/005,890, Dec. 19, 2000

Reexamination Certificate for:

| | |
|---|---|
| Patent No.: | **6,065,307** |
| Issued: | **May 23, 2000** |
| Appl. No.: | **09/332,667** |
| Filed: | **Jun. 14, 1999** |

(51) Int. Cl.[7] ..... A44C 17/02

(52) U.S. Cl. ..... 63/26; 63/28; 63/32; D11/89; D11/90; D11/91

(58) Field of Search ..... 63/26, 27, 28, 63/32; D11/89, 90, 91, 92

(56) References Cited

U.S. PATENT DOCUMENTS

D. 419,480 1/2000 Wolf ..... D11/90

*Primary Examiner*—B. Dayoan

(57) ABSTRACT

A combination precious or semi-precious stone setting is formed utilizing princess or square cut stones having their edges lopped off, with at least two of the stones joined edge to edge forming a space where the lopped off corners were located, further including a square cut stone placed in this space to form a novel and enhanced appearing jewelry setting.

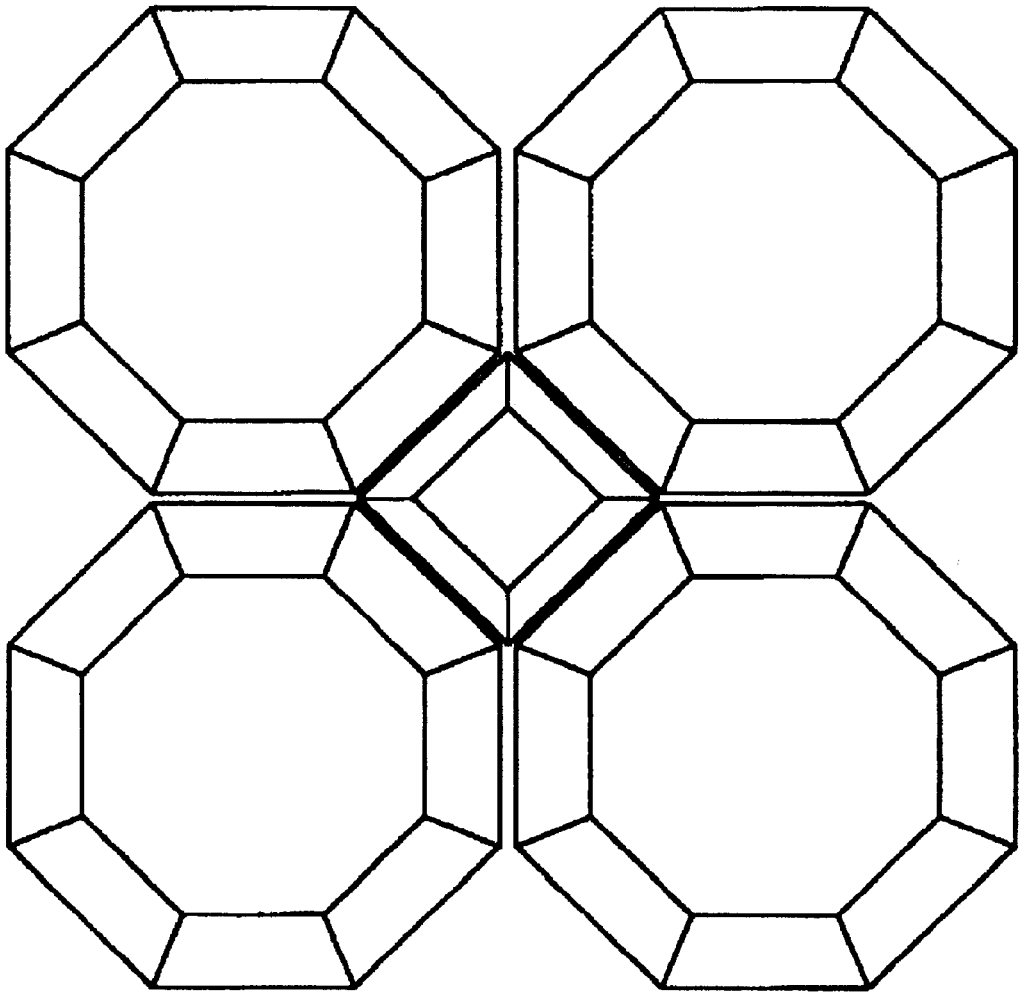

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–7 is confirmed.

Claim 9 is cancelled.

Claim 8 is determined to be patentable as amended.

8. A composite jewelry stone combination comprising four corner stones, said corner stones being of equal size, each of said four corner stones comprising a generally [triangular] *square* shape[, each of said four corner stones] having a *corner lopped off to form* a matching edge *extending between two abutting edges*, said four corner stones directly joined [corner to corner] *abutting edge to abutting edge* to form a space between said matching edges of each of said four corner stones, and a fifth stone being [of] square cut and having matching edges [with] *which match* said matching edges of each of said four corner stones, said fifth stone being placed in said space, wherein two other edges of each of said four corner stones have the same shape as two edges of said fifth stone, and wherein said composite jewelry stone combination has an appearance of a single princess cut stone.

* * * * *